US005483758A

United States Patent [19]

Gorza et al.

[11] Patent Number: 5,483,758

[45] Date of Patent: Jan. 16, 1996

[54] SECURING DEVICE FOR SPORTS SHOES

[75] Inventors: Roberto Gorza, Feltre; Giorgio Baggio, San Martino di Lupari; Mirco Battistella, Spresiano, all of Italy

[73] Assignee: Nordica S.p.A., Trevignano, Italy

[21] Appl. No.: 96,289

[22] Filed: Jul. 26, 1993

[30] Foreign Application Priority Data

Jul. 31, 1992 [IT] Italy ..... TV92A0090

[51] Int. Cl.[6] ..... A43B 5/04

[52] U.S. Cl. ..... 36/119

[58] Field of Search ..... 280/623, 625, 280/626, 634; 36/119, 117, 125, 121

[56] References Cited

U.S. PATENT DOCUMENTS 5,016,902 5/1991 Goud et al. ..... 280/625

FOREIGN PATENT DOCUMENTS 385185 8/1987 Austria .
0336921 5/1989 European Pat. Off. .
0316605 5/1989 European Pat. Off. .

*Primary Examiner*—Richard M. Camby
*Attorney, Agent, or Firm*—Guido Modiano; Albert Josif

[57] ABSTRACT

A device suitable to allow to secure the heel or the foot instep and is particularly usable for sports shoes, such as for example ski boots. The device is constituted by a support which can be coupled in a removable manner to a shell and/or to a quarter. A pair of jaws is associated with the support so that the jaws can rotate. The jaws embrace the foot instep or heel in a vise-like manner and can be activated by means of a knob which can be accessed by the user. The device is constructively very simple and allows to achieve optimum securing according to the anatomical shape of the part of the foot involved.

9 Claims, 3 Drawing Sheets

SECURING DEVICE FOR SPORTS SHOES

BACKGROUND OF THE INVENTION

The present invention relates to a securing device for sports shoes.

Particularly as regards ski boots, the problem of securing the region of the heel or instep of the foot so as to allow optimum transmission of forces from the leg to the ski while skiing is strongly felt.

Several devices are known for this purpose; for example U.S. Pat. No. 4,615,127 discloses a boot having a flexible flap at the rear part of the shell; the flexible flap interacts with pressure means. The pressure means are associated at the rear quarter and are constituted by a knob the rotation whereof pushes an adapted presser toward the flap.

This solution has a considerable drawback: a region of highly localized pressure is in fact created, causing considerable discomfort to the user, since a tendon subject to continuous contraction and relaxation is affected at this region.

Furthermore, the described use of a pair of wings arranged transversely to the flap, which can be moved mutually closer by means of an adapted screw, does not solve the problem, since said wings deform the flap, which is thus subject to breakage; the same is true for the rear quarter, since it is affected by the action of the screw.

Furthermore the assembly of the device on the boot is difficult.

Another important drawback is constituted by the fact that the stiffness of the wings, which is linked to the fact that they are located in a region adjacent to the malleoli, consequently requiring them to have a modest longitudinal extension, causes discomfort for particular anatomical configurations of the foot, since it has been observed that the free ends of the wings cause localized pressure regions as they are unable to embrace the entire affected region of the foot by following its anatomical shape.

U.S. Pat. No. 5,020,248 discloses a ski boot which comprises an adjustable foot support located in the heel region. The support is constituted by a U-shaped spring having a base located in the region of the heel and of the shell and having wings extending inside the shell. The wings can be adjusted with respect to one another by using a screw which is rotatably associated, transversely to the shell and is provided with a right-handed and left-handed threaded stem for the axial movement of appropriate washers.

This known solution has some drawbacks: on one hand, it requires a particular coupling of the springs and of the screw to the shell. Furthermore, the compression applied at the wings causes the wings to deform approximately at the base, while the free ends remain adjacent to the internal surface of the shell. This means that a localized pressure region is produced in the rear region of the heel; this pressure tends to push the foot forward, thus securing it by virtue of the interaction of its instep at the shell.

The foot is thus not secured in its natural position but is pushed and secured by interaction with the shell.

Austrian patent application no. 1130/85, dated Apr. 16, 1985 discloses a heel securing device which consists of a piece of lining which is arranged between a shell and an innerboot. The lining can be adjusted with the aid of a screw adjustment device and crosses the shell at the heel region at least longitudinally to the boot.

The piece of lining has two flaps which laterally surround the foot. The flaps divide in the direction of the innerboot and are provided with flexible portions. The adjustment screw acts on two positioning arms which adhere to the flaps of the piece of lining from outside.

The securing device operates at the innerboot and interacts with pivots which are pivoted at adapted protrusions which protrude inside the quarter. It is therefore considerably difficult to obtain these seats and consequently difficult to assembly the boot.

One also observes the possibility of deformation of the innerboots which, being localized, can lead to breakages, as well as of a possible deformation of the quarter due to the presence of the pivots.

Finally, it is noted that since the device affects the region adjacent to the malleoli, it tends to substantially narrow the innerboot, which compresses the foot in the direction of the tip of the shell, so that one obtains not so much a securing of the foot in its natural position as a securing of said foot by interaction with the shell.

Furthermore, the presence of the stem of the screw behind the upper region of the heel constitutes, since said stem is rigid, a factor of considerable discomfort for the user, because it interacts at a region of the foot which is affected by a tendon which contracts and extends.

SUMMARY OF THE INVENTION

The aim of the present invention is to eliminate the drawbacks described above in conventional boots and solve the described technical problems, providing a device which allows to optimally secure the foot instep or the heel once the foot has been inserted in the boot.

Within the scope of the above aim, an important object is to provide a device wherein said securing occurs in an anatomically correct manner, thus without creating localized pressure regions or creating forces which push the foot, for example toward the tip or the front quarter or the sole of the boot.

Another object is to provide a device which is structurally simple and easy to industrialize.

Another important object is to provide a device which has modest manufacturing costs and times.

Another object is to provide a device which can be used without requiring particular and complicated executions, for example at the quarter or at the shell of a ski boot, this allowing to further contain costs.

Another object is to provide a device which can be activated by the user in a simple manner.

Not least object is to provide a device which is reliable and safe in use.

This aim, these objects and others which will become apparent hereinafter are achieved by a securing device for sports shoes, characterized in that it comprises a support which can be coupled in a removable manner to a shell or to a quarter of a sports shoe, said support having at least one pair of jaws, said jaws being adapted to rotate and to embrace the foot in a vise-like manner, said jaws being rotated by means of a knob which can be accessed by the user.

BRIEF DESCRIPTION OF THE DRAWINGS

Further characteristics and advantages of the invention will become apparent from the detailed description of particular but not exclusive embodiments, illustrated only by way of non-limitative example in the accompanying drawings, wherein.

DESCRIPTION OF THE PREFERRED EMBODIMENTS

Figure 1:
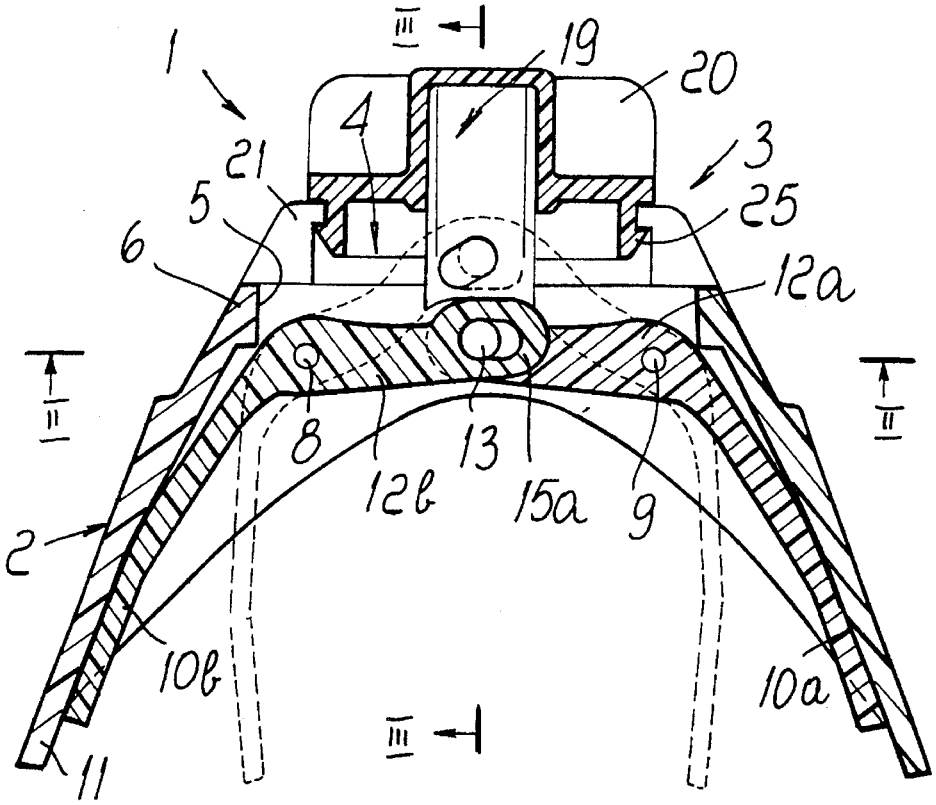
FIG. 1 is a partially sectional view of the device applied to the rear quarter of a shoe.
Figure 2:
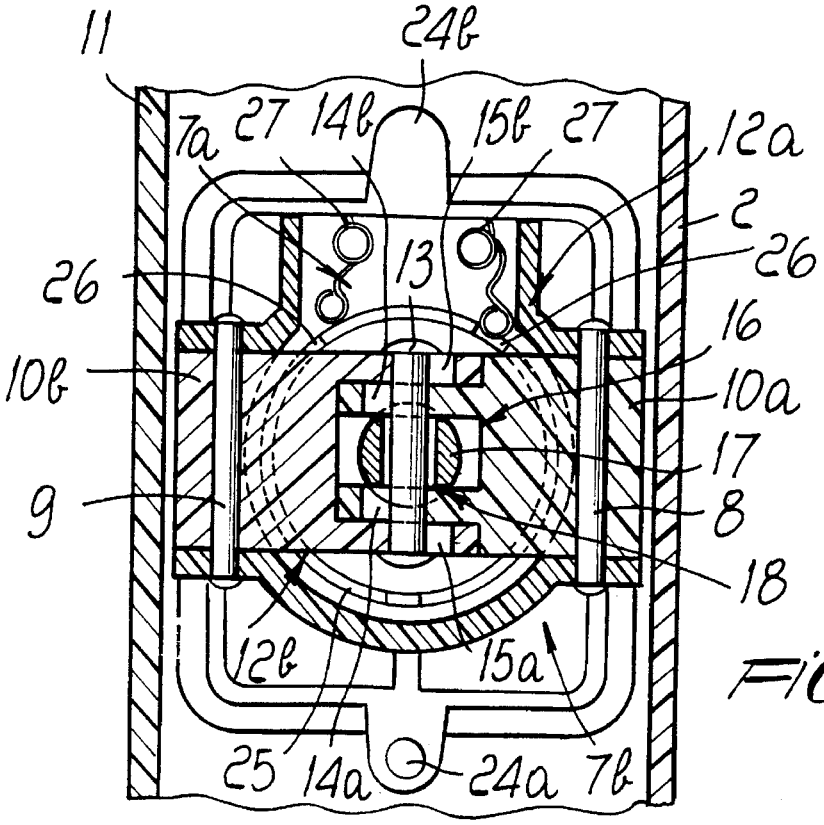
FIG. 2 is a sectional view, taken along the plane II—II of FIG. 1.
Figure 3:
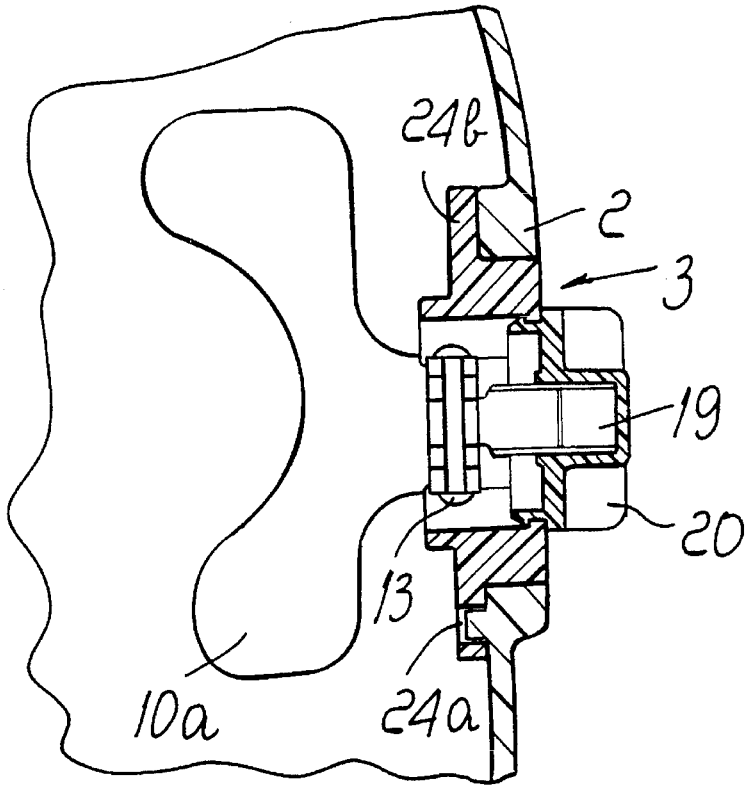
FIG. 3 is a sectional side view of the device according to the plane III—III of FIG. 1.

With reference to the above figures, the numeral 1 designates a heel or foot instep securing device, which is particularly usable for sports shoes such as for example ski boots, which comprise a shoe member, i.e., a shell or a rear quarter, designated by the reference numeral 2.

The device 1 can in fact be applied either at the heel or at the instep regions.

The securing device 1 is constituted by a support 3 which can be coupled in a snap-together manner at an adapted opening 4 formed on the rear quarter, or shell, 2.

Advantageously, the support 3 can be inserted in a snap-together manner from the inside of the rear quarter or of the shell, having an adapted first seat 5 at which it is possible to arrange a complementarily shaped first tab 6 which protrudes from the quarter, 2.

The support 3 is provided with a pair of shoulders 7*a* and 7*b* which protrudes toward the inside of the rear quarter or of the shell 2; the shoulders are essentially shaped like the uppercase letter omega (Ω), and a first pin 8 and a second pin 9 for the pivoting of a pair of jaws, designated by the reference numerals 10*a* and 10*b*, are interposed between the terminal ends of each pair of shoulders 7*a* and 7*b*.

Said jaws are essentially L-shaped and are pivoted to the first pin and to the second pin approximately where the wings join; the larger wing is shaped approximately complementarily to the internal lateral surface 11 of the rear quarter or of the shell 2 and can be arranged adjacent thereto.

In the inactive condition in which the larger wings are adjacent to the internal lateral surface 11 of the rear quarter of the shell 2, the shorter wings 12*a* and 12*b* of the jaws 10*a* and 10*b* are arranged approximately at the same plane, and are mutually articulated by virtue of the presence of a third pin 13 which passes through first pairs of slots 14*a* and 14*b* and second pairs of slots 15*a* and 15*b* formed respectively proximate to the terminal ends of the wings 12*a* and 12*b* which are mutually articulated.

The wing 12*a* of the jaw 10*a* is furthermore centrally provided with a second seat 16 for the end of a flattened stem 17 on which an adapted hole 18 is provided for connection to the pair of jaws by means of the third pin 13.

Said stem 17 is externally threaded at the end which does not interact with the third pin 13 and is associated with a complementarily threaded third seat 19 provided axially with respect to a movable adjustment member or knob 20 which can be accessed by the user and is freely rotatably associated at a tab or protuberance 21 of the support 3 which protrudes outside the rear quarter or shell 2.

The knob 20 has an inner rim 25 provided with a series of evenly spaced notches 26. The upper omega-shaped shoulder 7*a* is open in the middle providing a seat for two spring members 27 adapted to engage the notches 26.

The numerals 24*a* and 24*b* designate tabs which protrude from the support 3 and are suitable to interact with the internal surface of the quarter 2 so as to prevent extraction of said support 3.

It is possible to provide screws for mutual fixing between the tabs 24*a* and 24*b* and the quarter 2; or, as illustrated in the figures, the lower tab 24*a* may have a hole engaged by a protrusion provided on the shell or boot.

The use of the device is thus as follows: starting from the position shown in FIG. 1, in which the larger wings of the jaws 10*a* and 10*b* are adjacent to the internal lateral surface 11 of the rear quarter or shell 2, the user can impart an axial movement to the stem 17 by activating the knob 20.

Movement of the stem toward the knob 20 causes the pulling of the mutually articulated ends of the shorter wings 12*a* and 12*b* and consequently, by virtue of their pivoting at the first pin 8 and at the second pin 9, a vise-like embracing of the underlying foot instep or heel.

It is stressed that the activation of the larger wings of the jaws 10*a* and 10*b* does not push the rear part of the heel or the upper part of the foot instep but tends to embrace them in a vise-like manner.

It is thus possible, once the foot has been placed inside the shoe, to secure it in an anatomically correct manner, without pushing it from above (in the case of the foot instep) or from the rear (in the case of the heel).

It has thus been observed that the invention has achieved the intended aim and objects, a device having been achieved which allows to secure the foot instep or the heel in an optimum and anatomically correct manner, without creating localized pressure regions at the rear part of the heel or at the foot instep.

The foot is thus correctly secured in its position inside the shell, allowing to transmit efforts to the ski in an optimum manner.

The device is naturally susceptible to numerous modifications and variations, all of which are within the scope of the same inventive concept.

Figure 5:
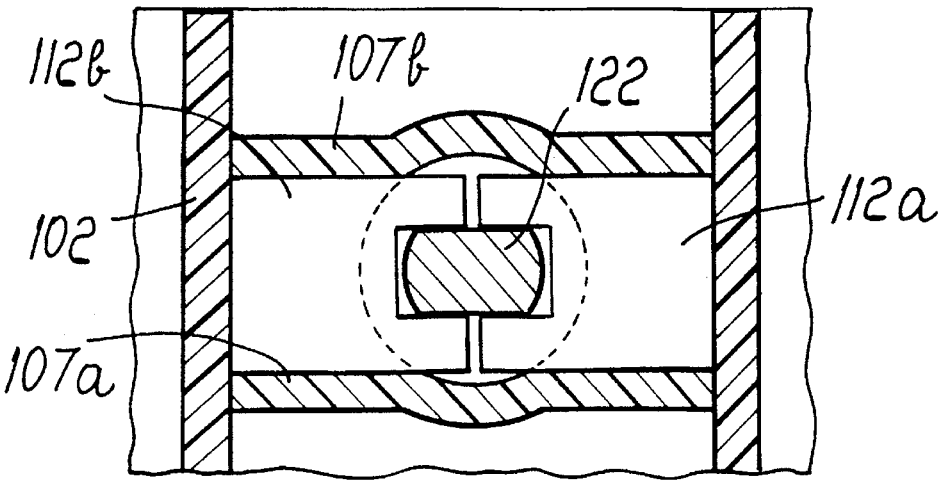
FIG. 5 is a sectional view, taken along the plane V—V of FIG. 4.
Figure 4:
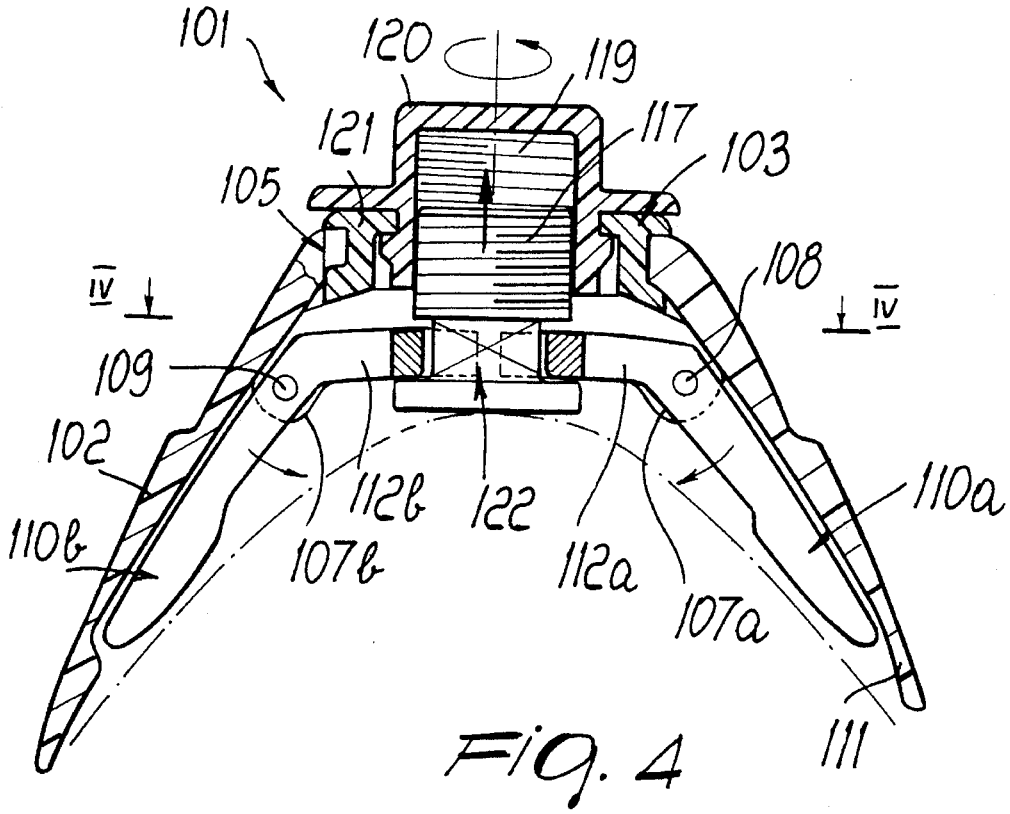
FIG. 4 is a view, similar to that of FIG. 1, of a second embodiment.

Thus, for example, FIGS. 4 and 5 illustrate a first embodiment for a securing device 101, which is constituted by a support 103 which can be coupled at an adapted opening provided on the rear quarter or on the shell 102.

This connection is allowed by virtue of the fact that the support 103 has a second tab 121 on which a first seat 105 is formed at its lateral surface; the perimetric edge of the rear quarter or of the shell 102, defined by the opening formed thereon for the insertion of said support 103, can be temporarily coupled at said seat 105.

The support 103 has, toward the inside of the rear quarter or of the shell 102, a pair of shoulders 107*a* and 107*b* which is arranged adjacent to the internal lateral surface 111 of the rear quarter or of the shell; a pair of essentially L-shaped jaws 110*a* and 110*b* is articulated between said shoulders by virtue of an adapted first pin 108 and of a second pin 109.

Said pair of jaws is articulated at said first and second pins approximately at the intersection of the wings.

The larger wings are arranged approximately adjacent at the lateral surface 111 of the rear quarter or of the shell, whereas the shorter wings, designated by the reference numerals 112*a* and 112*b*, are arranged approximately at the same plane and have a fork-shaped terminal end arranged at a second flattened seat 122 formed proximate to an end of the stem 117.

At its other end, said stem 117 is threaded and associated with a complementarily threaded third seat 119 defined axially and internally to a knob 120 which can be gripped by the user and be associated, in a snap-together manner, at the second tab 121 of the support 103.

In this case, too, the rotation imparted to the knob 120 entails an axial movement of the stem 117 and, consequently, a rotation of the larger wings of the pair of jaws 110*a* and 110*b*, which embrace the foot instep or the heel in a vise-like manner.

In this case, too, the described solution solves the technical problems described in the known art, achieving the intended aim and objects.

Figure 6:
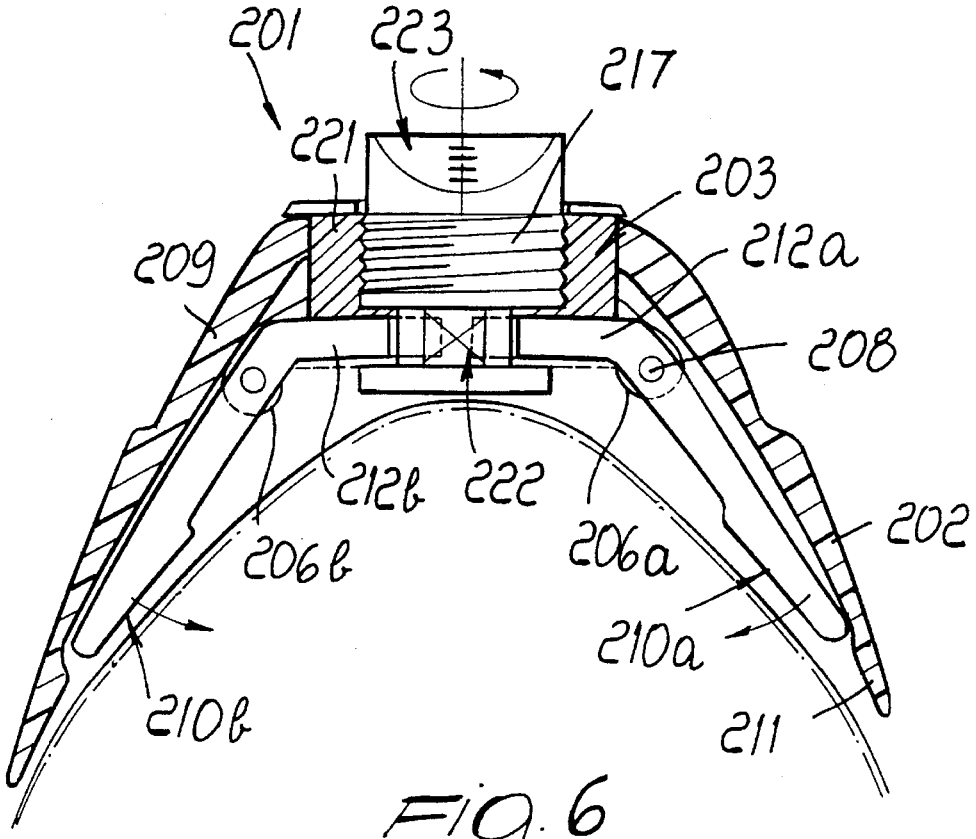
FIG. 6 is a view, similar to that of FIG. 3, of a third embodiment of the invention.

FIG. 6 illustrates a further embodiment of a securing device 201 which is again constituted by a support 203 which can be temporarily associated with a rear quarter or shell 202 at an adapted opening defined thereon.

The support 203 is provided, inside the rear quarter or shell, with a pair of first tabs 206*a* and 206*b* which are suitable to allow the pivoting, by means of a first pin 208 and a second pin 209, of a pair of essentially L-shaped jaws 210*a* and 210*b*.

Said jaws are pivoted at the first and second pins approximately where the wings join; the larger wings can be arranged adjacent to the internal lateral surface 211 of the rear quarter or of the shell 202, and are shaped approximately complementarily with respect to said surface.

When the longer wings are adjacent to the internal lateral surface 211, the shorter wings 212*a* and 212*b* of the pair of jaws 210*a* and 210*b* are arranged approximately at the same plane; their free ends are fork-shaped and can thus be arranged within a second flattened seat 222 formed at the stem 217.

Said stem 217 has, on the side opposite to the inside of said rear quarter or shell, a threaded external surface which interacts with a complementary thread formed at the second tab 221 of the support 203.

Said stem 217 has, at the end which is external to said rear quarter or shell, a knob 223 which is suitable to allow the rotation of said stem 217.

This solution, too, allows to achieve the intended aim and objects, solving the technical problems described in the known art.

The dimensions and the materials which constitute the individual components of the device may naturally be the most pertinent according to the specific requirements.

We claim:

1. In combination, a sports shoe having a shoe member constituted by a shell or a quarter having an internal lateral surface, and a foot securing device removably coupled to said shoe member for securing a wearer's foot within said sports shoe, said securing device comprising;

a support removably coupled to said shoe member;

two shoulders defined by said support, said shoulders having terminal shoulder ends and protruding toward an inside of said shoe member;

at least one pair of essentially L-shaped jaws for embracing a wearer's foot in a vise-like manner;

two wings defined by each of said jaws, said two wings including a larger wing and a shorter wing having a terminal end, said larger wing shaped approximately complementarily to the internal lateral surface of said shoe member and arrangeable adjacent thereto, said shorter wing being arranged substantially along a plane when said larger wings are located adjacent to said internal lateral surface;

first and second pins interposed between the terminal ends of said shoulders, each of said jaws being pivotally connected to one of said first and second pins substantially at a juncture of said larger wing and said shorter wing;

slots formed in said terminal end of said shorter wing of each of said jaws;

a third pin passing through said slots for mutually articulating said terminal ends of said shorter wings;

a knob which can be accessed by a user for rotating said jaws.

2. Combination according to claim 1, further comprising a flattened stem having an end, a second seat for accommodating said end of said flattened stem provided on said shorter wing of one of said jaws, and a hole formed on said flattened stem, said third pin passing through said hole whereby to connect said stem to said pair of jaws.

3. Combination according to claim 2, further comprising a protuberance defined by said support and protruding outside said shoe member, an externally threaded end defined on said stem at an end thereof remote from said third pin, a complementarily threaded seat formed axially in said knob, said externally threaded end engaging said complementarily threaded seat, said knob being freely rotatably connected to said protuberance.

4. Combination according to claim 1, further comprising an opening formed in said shoe member, a first seat defined by said opening, and a complementarily shaped tab protruding perimetrically with respect to said opening, said support being inserted in a snap-together manner at said opening.

5. Combination according to claim 1, further comprising an opening formed in said shoe member, a perimetric edge defined by said opening, a tab having a lateral surface formed on said support, and a first seat formed at said lateral surface of said tab, wherein said perimetric edge defined by said opening in said shoe member is temporarily connectable to said first seat.

6. Combination according to claim 5, further comprising a stem having a stem end, said stem end being located internally of said shoe member, a flattened seat formed proximate to said stem end, and a fork-shaped terminal end defined by each said shorter wing and engaging said flattened seat.

7. Combination according to claim 6, wherein said stem has an end provided with an annular seat, and a threaded end, a complementarily threaded axial seat being formed internally of said knob, said threaded end of said stem engaging said complementarily threaded axial seat, said knob being connectable in a snap-together manner to said tab of said support.

8. Combination according to claim 6, further comprising a threaded external surface formed on said stem externally of said shoe member, and a complementarily thread formed at said tab of said support, wherein said threaded external surface engages said complementarily thread formed.

9. Combination according to claim 8, wherein said knob is connected to an end of said stem located externally with respect to said shoe member for permitting rotation of said stem.

* * * * *